US006460854B1

(12) United States Patent
McCarey

(10) Patent No.: US 6,460,854 B1
(45) Date of Patent: Oct. 8, 2002

(54) PUZZLE TYPE GAME

(76) Inventor: James Roy McCarey, One Sheridan Square, Apt. 5C, New York, NY (US) 10014-6827

( * ) Notice: Subject to any disclaimer, the term of this patent is extended or adjusted under 35 U.S.C. 154(b) by 0 days.

(21) Appl. No.: 09/436,417

(22) Filed: Nov. 9, 1999

(51) Int. Cl.[7] ..... A63F 1/00
(52) U.S. Cl. ..... 273/272; 272/283; 272/273
(58) Field of Search ..... 273/283, 272, 273/273, 275, 281, 287, 288, 299, 146, 294

(56) References Cited

U.S. PATENT DOCUMENTS

| | | | | | |
|---|---|---|---|---|---|
| 163,601 | A | * | 5/1875 | Morgan | 273/136 |
| 1,286,631 | A | * | 12/1918 | Hillyard | 273/136 |
| 1,481,628 | A | * | 1/1924 | Souza | 273/136 |
| 1,633,445 | A | * | 6/1927 | Gail et al. | 273/136 |
| 2,586,017 | A | * | 2/1952 | Freedman | 41/34 |
| 2,848,237 | A | * | 8/1958 | Svejnoha | 273/136 |
| 3,929,337 | A | * | 12/1975 | Hayes | 273/134 C |
| 4,171,815 | A | * | 10/1979 | Sturtz | 273/272 |
| 4,591,161 | A | | 5/1986 | Vanderhoof | 273/272 |
| 4,892,319 | A | * | 1/1990 | Johnson, II | 273/272 |
| 4,966,366 | A | * | 10/1990 | Mercado-Torres | 273/1 R |
| 5,304,064 | A | * | 4/1994 | Atkinson | 273/146 |
| 5,395,118 | A | * | 3/1995 | Barrett | 273/272 |
| 5,558,328 | A | * | 9/1996 | Krantz | 273/146 |
| 5,615,886 | A | * | 4/1997 | Chalfin et al. | 273/272 |
| 5,746,428 | A | * | 5/1998 | Fredenburg | 273/146 |
| 5,794,933 | A | * | 8/1998 | Chalfin et al. | 273/272 |
| 5,799,943 | A | * | 9/1998 | Morgan | 273/272 |
| 5,816,572 | A | * | 10/1998 | Chalfin | 273/272 |
| 6,116,603 | A | * | 9/2000 | Huang | 273/269 |

FOREIGN PATENT DOCUMENTS

| | | | |
|---|---|---|---|
| GB | 465979 | | 5/1937 |
| GB | 1198979 | | 7/1970 |
| GB | 2071505 A | * | 9/1981 |
| GB | 0076477 A | | 4/1983 |
| GB | 2116439 A | * | 9/1983 |
| GB | 2203054 A | * | 10/1988 |
| GB | 2223954 A | | 4/1990 |

* cited by examiner

*Primary Examiner*—Benjamin H. Layno
*Assistant Examiner*—Dolores Collins
(74) *Attorney, Agent, or Firm*—Gottlieb Rackman & Reisman PC

(57) ABSTRACT

A game for playing a game based on a crossword puzzle includes a field with squares on which pieces can be overlaid to simulate the crossword puzzle. The field is partitioned into zones assigned to the different players. Pieces are positioned by the players in turn to define entries for the puzzle. Points can be assigned to the entries and at the end of the game, when no more entries can be made by a player, the points are tabulated to determine a winner.

15 Claims, 7 Drawing Sheets

| | | | | | | | | | | | | | | |
|---|---|---|---|---|---|---|---|---|---|---|---|---|---|---|
| M | I | N | C | E | | S | I | C | K | | S | O | D | A |
| A | V | A | I | L | | O | B | O | E | | E | R | I | N |
| N | A | I | V | E | | L | I | A | R | | S | A | N | G |
| E | N | S | I | G | N | | S | T | O | M | A | T | A | L |
| | | | L | A | I | C | | I | S | O | M | E | R | E |
| C | H | A | I | N | L | E | T | | E | R | E | | | |
| R | A | B | A | T | | D | I | A | N | A | | P | A | T |
| O | M | E | N | | H | O | U | S | E | | C | O | D | E |
| W | E | D | | B | I | D | E | D | | I | O | N | I | A |
| | | | S | I | N | | R | I | N | G | L | E | T | S |
| P | R | O | T | E | S | T | | R | E | N | O | | | |
| R | E | P | O | R | T | E | D | | B | O | R | A | T | E |
| O | M | E | N | | R | A | I | L | | R | I | S | E | R |
| F | A | R | E | | E | S | N | E | | E | S | T | E | R |
| S | P | A | S | | L | E | E | T | | S | T | I | R | S |

FIG. 7

PUZZLE TYPE GAME

BACKGROUND OF THE INVENTION

A. Field of Invention

This invention pertains to a board game which is based on a crossword puzzle. More particularly, this invention pertains to a game having a board and pieces which are placed on the board to complete a preselected crossword puzzle, said game being played by two or more players with scores being awarded as pieces are positioned on the board.

B. Description of the Prior Art

Crossword puzzles have fascinated people for centuries. A crossword puzzle typically consists of a square or rectangular grid defining a plurality of boxes. Some of the boxes are blank and the remaining boxes are filled in entries formed of with alphanumerical characters using clues provided for the entries in the horizontal and vertical directions.

Crosswords can have varying degrees of difficulty, related generally to the kind and specificity of clues being given, their subject matter, size, configuration, and so on. Because of their flexibility, crosswords are very challenging to a broad spectrum of people. As a result, crosswords are published on a daily basis in books, magazines, newspapers, and other media. A crossword puzzle may be solved or completed by more than one individual, for example, by taking turns and making different entries, each entry consisting of a plurality of alphanumeric characters, usually words. However, overwhelmingly, solving crossword puzzles is a solitary activity.

Games have been previously sold which had some elements of crossword puzzles. The best known of these types of word games was probably Scrabble. However, none of these games generate the fascination and require the creativity and the challenge posed by the original crossword puzzles. Furthermore, prior games do not take advantage of and cannot use standard crossword puzzles that have been previously published or are presently available.

OBJECTIVES AND SUMMARY OF THE INVENTION

In view of the above named disadvantages, it is an objective of the present invention to provide a board game which provides the same challenge and ingenuity as regular crosswords.

A further objective is to provide a game which allows several persons to compete while solving a standard crossword puzzle.

Yet a further objective is to provide a game which can be used to play crosswords of various sizes and shapes.

A further objective is to provide a game which, in addition to solving a crossword puzzle, also provides for awarding points for different moves thereby providing more challenge to the game.

Other objectives and advantages of the invention shall become apparent from the following description.

Briefly, a game constructed in accordance with the present invention includes a board on which a field of play is defined by a plurality of squares. Some of the squares are black to imitate the black boxes of a preselected crossword puzzle. The field of play is partitioned into four zones. In one embodiment, two diagonally opposed zones are assigned to each player.

A plurality of multi-faceted pieces are placed on the board. These pieces have surfaces with indicia (such as alphanumeric characters). Thus, the pieces can be placed on the board to make entries for the unsolved puzzle. A match is played by two players taking turns to make entries by filling in all or some of the letters of each word, in accordance with a set of rules. Points are awarded for at least some of the entries. The entries can be made to span at least two zones. A match ends when one of the players cannot move.

In an alternate embodiment, more than two players can play a match.

BRIEF DESCRIPTION OF THE INVENTION

FIG. 7 shows a plan view of the playing field at the end of a match.

DETAILED DESCRIPTION OF THE INVENTION

Figure 1:
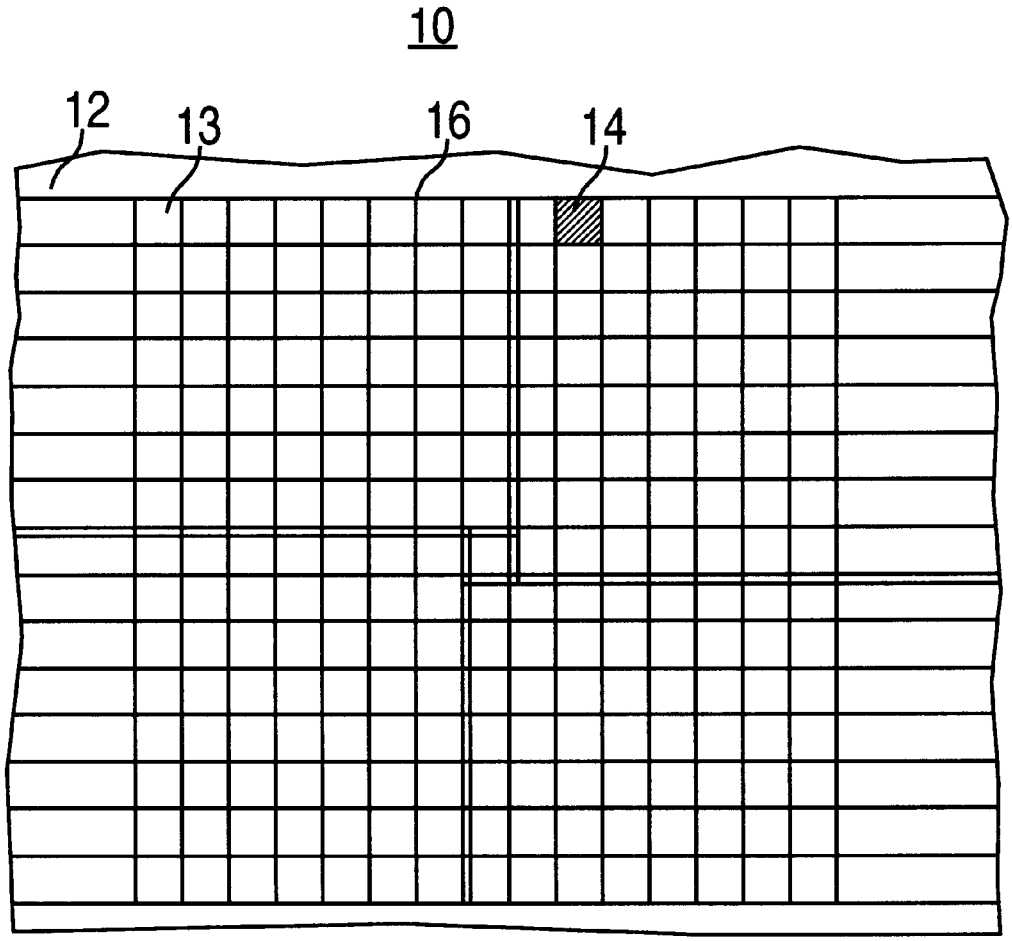
FIG. 1 shows a plan view of a playing field for the subject application partitioned into several zones.

Referring first to FIG. 1, the game 10 consists of a board 12 with a plurality of squares 13. The number of squares 13 used is dependent on the size of the puzzle to be solved. In FIG. 1, it is assumed that a standard 15×15 puzzle is used and hence 225 squares are shown. The squares 13 are arranged in a rectangular or square array to define the playing field 16. The squares may be painted on the board 12 or can be defined by placing a plurality of cubes 14 described in detail below.

Figure 1A:
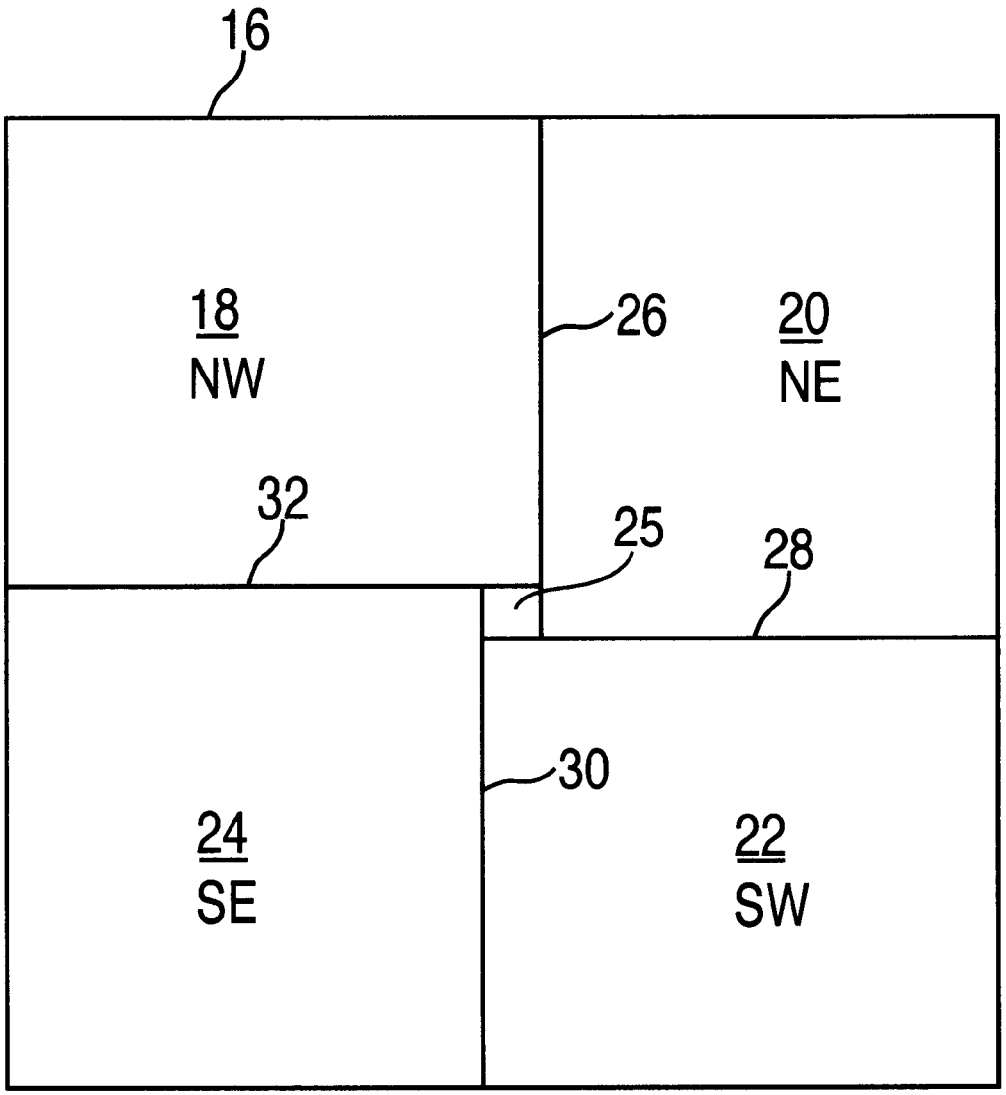
FIG. 1A shows a plan view of the playing field without the squares to show how it is partitioned into the different zones.

The playing field 16 is partitioned into four equal zones 18, 20, 22, and 24 as illustrated in FIG. 1A. (In FIG. 1A, the squares 13 have been omitted for the sake of clarity.) In the game, the four zones are referred by their cardinal positions as NW, NE, SE, and SW, respectively as shown.

Preferably, each of the zones 18–24 is rectangular having the dimensions of 7×8 squares. The center square 25 of field 16 does not belong to any one of the zones 18–24, but instead, it is assigned a separate zone, called the neutral zone (NZ).

The playing field 16 with its five zones may be implemented in a number of ways. For example, the board 12 can be made of from four rectangular cardboard pieces, each piece corresponding to one of the zones. Assuming that the squares 13 are ½", the cardboard pieces defining the zones can be about 9"×8½"×¼" with two of the pieces corresponding to zones 18 and 22 having one color, such as red, and the other two pieces corresponding to zones 20 and 24 having a different color, for example blue. The game may also be provided with four flat strips 26, 28, 30, and 32 having a width greater than the thickness of the board pieces defining the zones. The strips 26–32 can be arranged so that they are positioned and trapped between the two corresponding adjacent board pieces and extend upwardly. The strips could be 9"×½"×1/16" and could be made of wood, paper or metal.

Figure 2A:
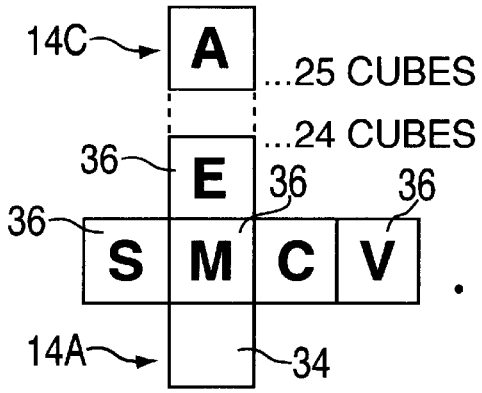
FIGS. 2A–2F show development views for the six different types of playing cubes used in the game.
Figure 2B:
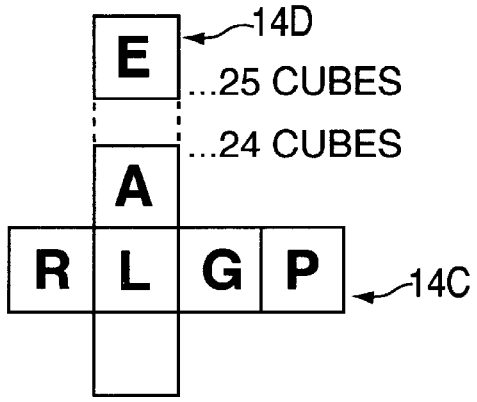
Figure 2C:
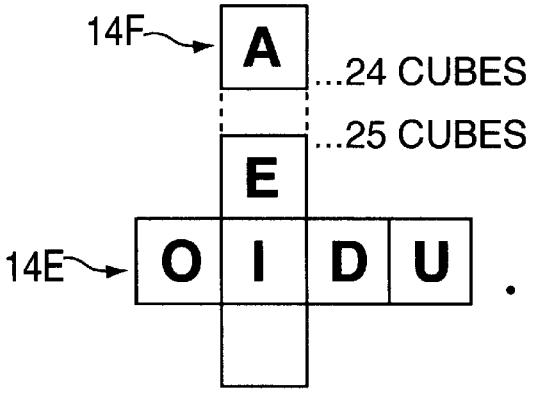
Figure 2D:
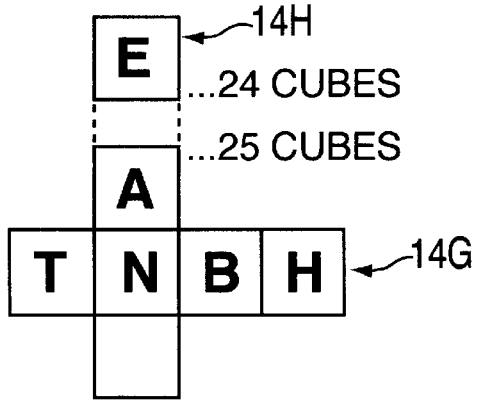
Figure 2E:
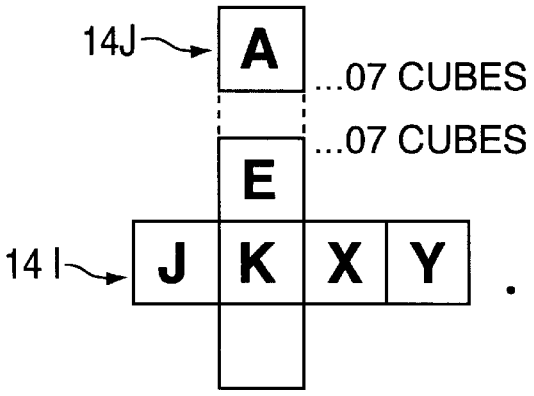
Figure 2F:
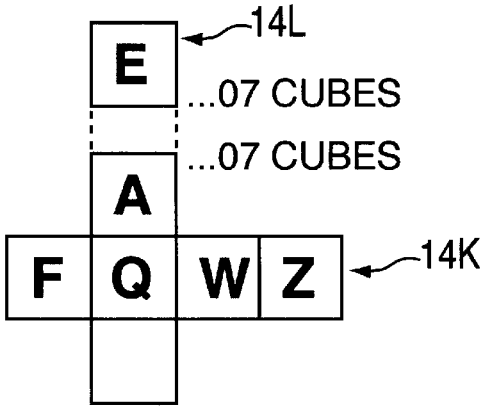

As discussed above, the game is further provided with a plurality of cubes 14. More specifically, two types of cubes are provided. One type of cube is made with a white face and a letter (of other alphanumeric indicia) on each of the other five faces. The inventor has found that the game can be played with a total of 24 different types of cubes with letters. FIG. 2A shows two such cubes 14A and 14B (only one face of cube 14B is seen in FIG. 2A since its other faces are identical to the faces of cube 14A). Cube 14A has a white face 34 and five other faces 36 bearing letters S, M, C, V, and E, respectively. Cube 14B is similar to cube 14A except that one face has the letter A instead of E.

FIGS. 2B–2F show how cubes 14C, 14D, 14E, 14F, 14G, 14H, 141, 14J, 14K, and 14L are made. Just like in FIG. 2A, the cubes in each of these Figures differ only in that the letters A are substituted for letters E. The following numbers of cubes of each type have been found to be sufficient for any matches:

| CUBE TYPE | NUMBER |
|---|---|
| 14A | 24 |
| 14B | 25 |
| 14C | 24 |
| 14D | 25 |
| 14E | 25 |
| 14F | 24 |
| 14G | 25 |
| 14H | 24 |
| 14I | 7 |
| 14J | 7 |
| 14K | 7 |
| 14L | 7 |

In addition, a number of extra cubes 14X (for example 50) are provided which are black on at least one face. Preferably, these latter cubes do not have any letters or any other indicia. Alternatively, these extra cubes could also have some letters on some faces, so that they can be used if some of the 14A–14L cubes with letters are missing or lost.

Figure 3:
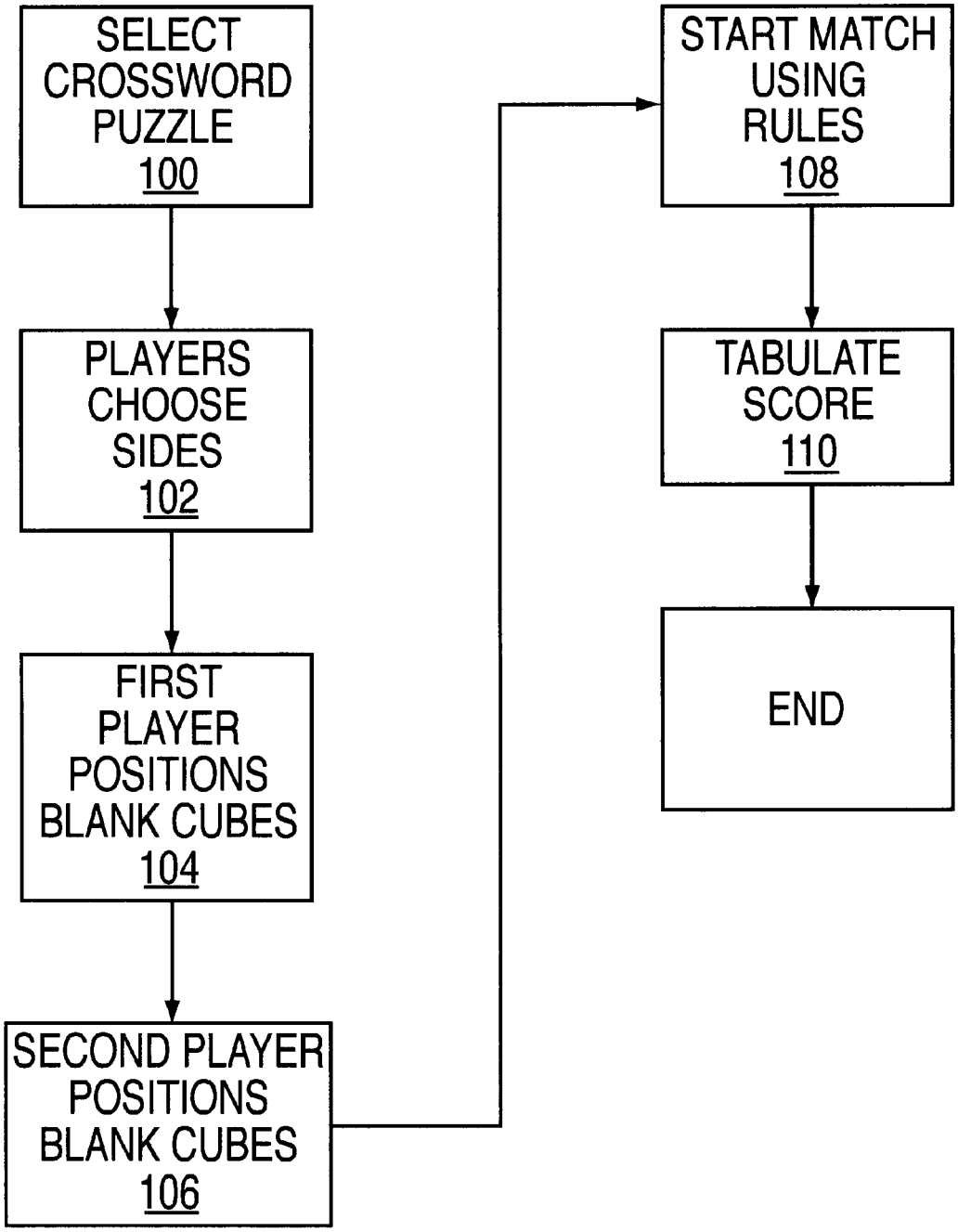
FIG. 3 shows a flow chart for playing a match using the subject game.
Figure 4:
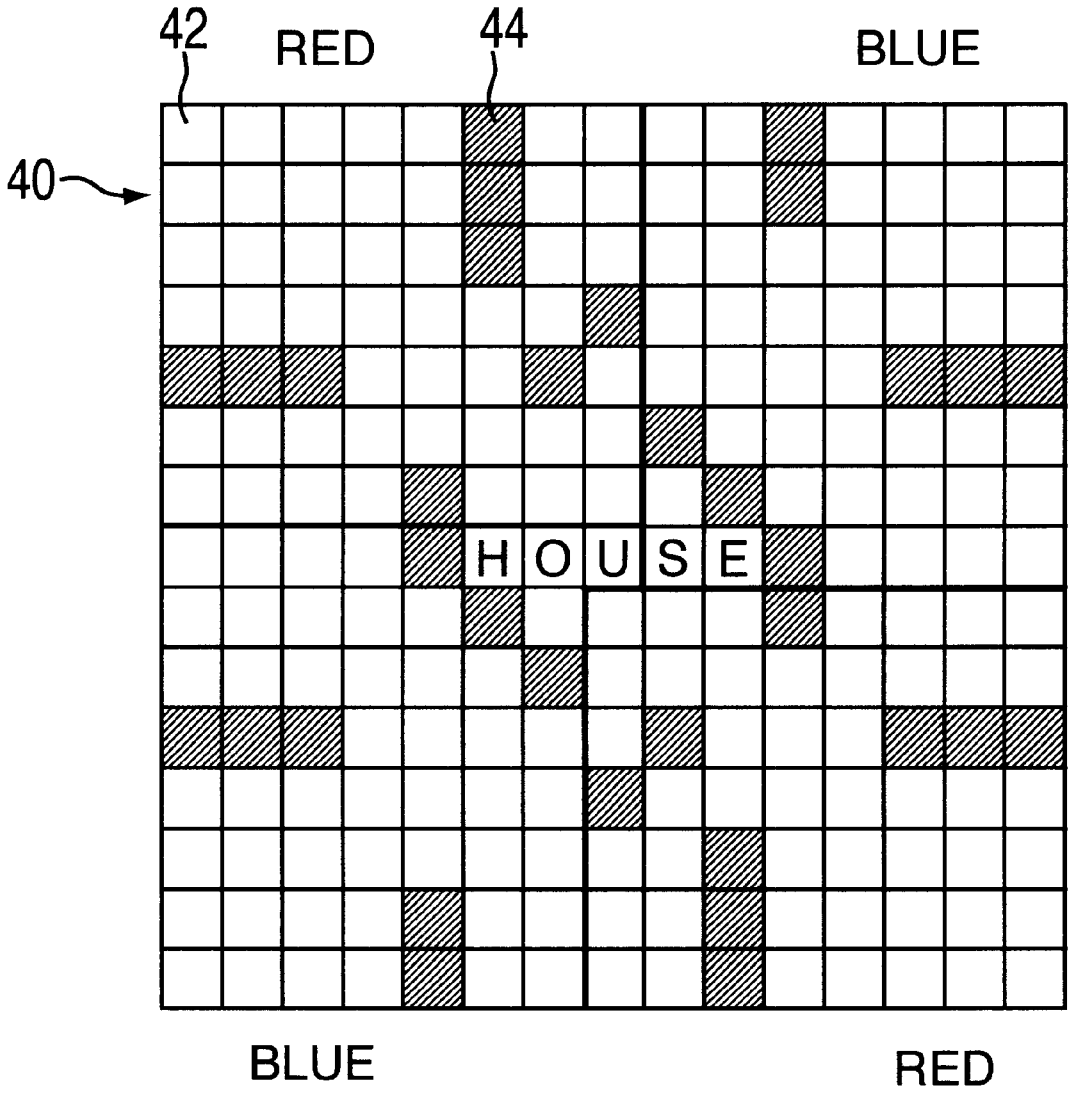
FIG. 4 shows a typical crossword puzzle partitioned into zones in accordance with FIG. 1.

Having described the components of the game, the rules for playing the match for the game 10 will now be described in conjunction with FIG. 3 and the other Figures. FIG. 3 shows a flow chart for playing a typical match. A match starts in step 100 with the selection of a crossword puzzle to be solved. For example, the game 10 may come with a set of 50 or more preprinted puzzles. The players may elect to play using any one of these puzzles. Alternatively, the players may use a new puzzle from a magazine, newspaper, or any other source. One typical crossword puzzle 40 is shown in FIG. 4, having white boxes 42 which can be filled with alphanumeric characters in accordance with a list of clues (not shown) alternating with black boxes 44. Puzzle 40 also includes numerals in some of the boxes 42 to indicate the positions where entries defined by the clues start. These numerals have been omitted. For the sake of clarity.

In step 102, the players decide who goes first, either by flipping a coin, by using a two sided disk with the colors of zones 18–24, or by any other means.

Figure 6:
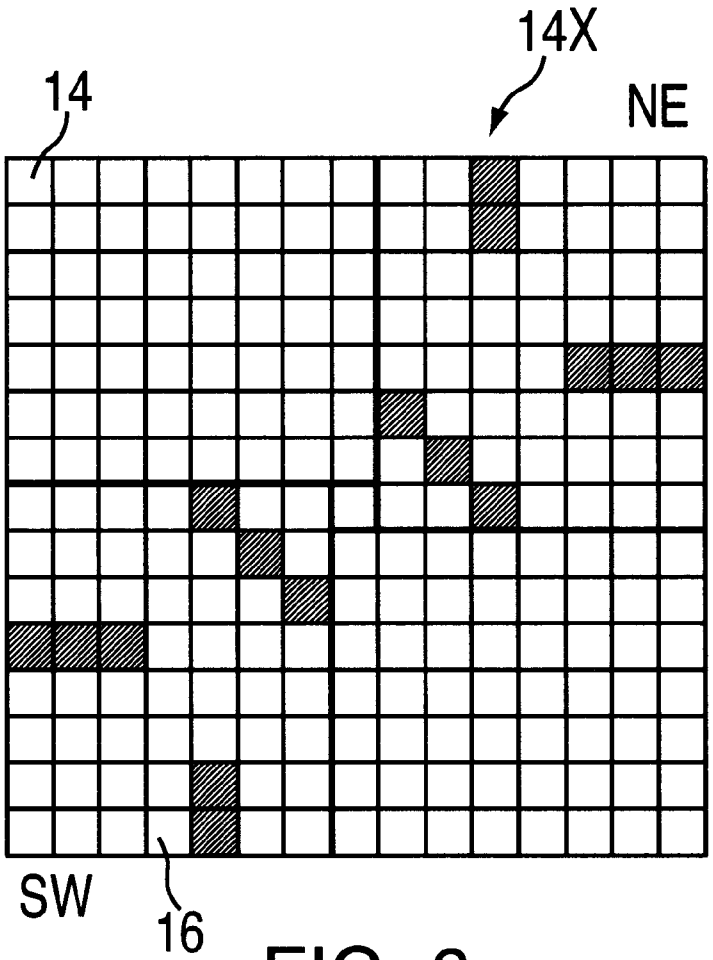
FIG. 6 shows the zones of the playing field after placement of the blank cubes by the second player at the beginning of a match.
Figure 5:
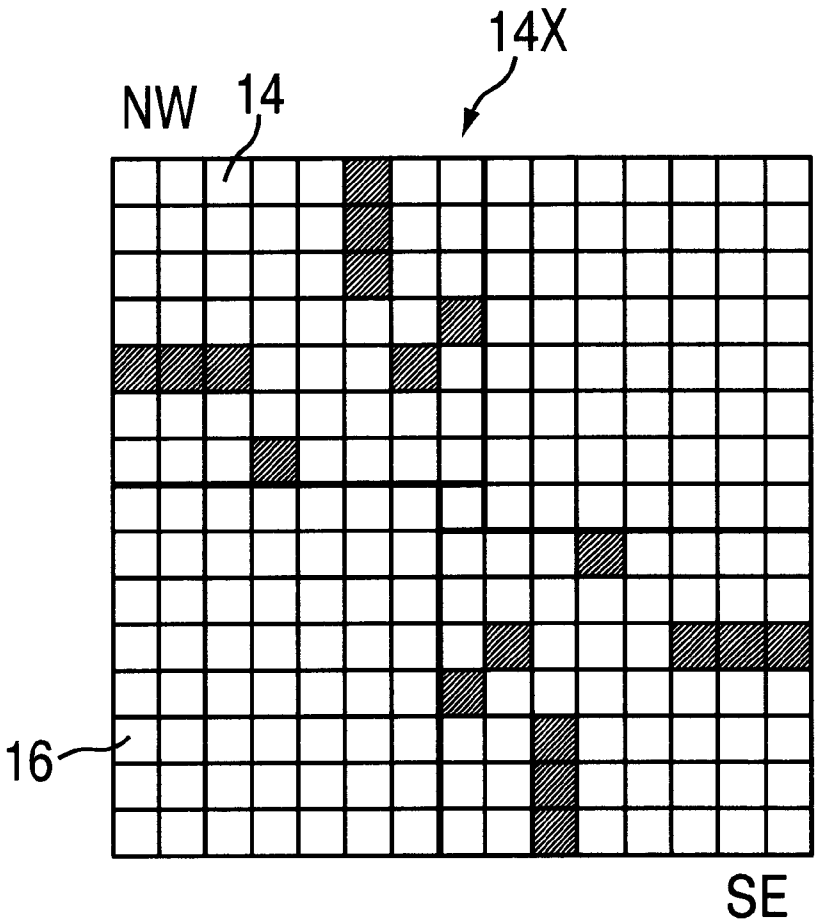
FIG. 5 shows the zones of the playing field after placement of the blank cubes for he first player.

Next, in step 104 the first player places cubes 14X with black faces in his zones. FIG. 5 shows the playing field 16 after the first player completes step 104. In step 106, the second player then places cubes 14X in his zones, as indicated in FIG. 6. After all the cubes 14X have been placed, the field of play 16 is composed of empty squares and cubes 14X with black (or other colored) faces showing at all times. Thus, at the end of step 106, the field 16 looks the same as the puzzle 40 in FIG. 4. Next, the rest of the players field 16 is populated with cubes 14 having a blank face on top and the faces with letters on the sides and bottom. Alternatively, the cubes 14 can be placed on board 12 at the end of step 100 (i.e., when the size of the selected puzzle is known). Then during steps 104, 106 each cube 14X is used to replace one of the cubes 14. A twizzer may be used to lift out each cube 14 and replace it with a cube 14X. The cubes 14 removed from the field when the black cubes 14X are placed thereon, can be used by each side as required during the game to complete a particular word.

More importantly, the two players do not get the same cubes 14 (except for the cubes 14X which arc identical). Instead, the cubes shown in FIGS. 2A–F are partitioned between the players so that each has about half of the alphabet letters. For example, the red player may be assigned cubes shown in FIGS. 2C, 2D and 2F while the blue player is assigned the cubes of FIGS. 2A, 2B and 2E.

A match is then played by following a set of rules (step 108). During this step, each player takes his turn and makes a move by filling an entry (horizontal or vertical) in the puzzle using the appropriate clues provided. An entry consists of placing in the appropriate place on the board one or more letters of the word defined by the clues. Importantly at least initially, each entry made by a person must be completely or partly disposed in his own zone. Whenever an entry is made, the player may be entitled to a certain predetermined number of points. It is preferable that some of the entries saddle or overlap two adjacent zones as discussed below. Since each player controls opposite zones, an entry extending over two adjacent zones automatically crosses a portion of the zone controlled by both players The following rules are applied to make entries:

a A player can make an entry only if he has a cube in his possession with a letter for either the first or last position of each entry. For example, if an entry is the word HOUSE, a player must have either the letter H or E. If he has one of these letters, he can make an entry for the word by filling in one or more of the letters of this word.

b. A player can make entries using only cubes in stock, on his territory, or cubes that have been captured. Cubes in stock are cubes that are left over after the puzzle has been formed on the board. For example, the red player may have the letters O, S and E. He then removes the second, fourth and fifth cubes disposed in the space for HOUSE and replaces them with the correct cubes. Cubes removed from the blue zone are captured cubes. The captured cubes are important since they have been letters which the player does not own originally, as discussed above. Strategically, replacing cubes in the opposite territory is advantageous because it gives the player points and letters which he could not obtain otherwise. Replacing cubes in one's own territory is important to block the other player.

c. During a move, a player can make an entry for a word (by fully or partially replacing the cubes, as discussed above) and can use captured cubes in other words which have been previously entered by either player.

When one player cannot make any further moves any further in his own zone, he can complete entries located in enemy zones in their entirety. When neither player can make any more entries either on his own, or in a zone of the opponent, the game ends.

Next, in step 110, the score is calculated and a winner declared.

FIG. 7 shows the playing field 16 after a match is completed. Scoring is performed as follows.

Each player starts with the number of squares in its zones. In the example given above, each player starts with 112 squares. Next, the following items are deducted from this total number:

the number of black cubes 14X in each zone;

the number of spelling errors made by the player;

the number of cubes used by the opponent for his entries in the player's zones.

If a player makes an entry which covers the neutral zone (NZ), he gets a bonus of two points. Each player gets one point for each captured cube.

The resulting net totals are compared and the player with the higher score wins.

Other rules for scoring a game may be used instead.

In one embodiment, the game can be played by two players. In another embodiment, four players can play, each player being assigned one of the zones. The four players can form two teams in a manner similar to bridge.

The game has been described above as being implemented as, and being played as, a board. However, the game may be easily implemented by software on a computer as well.

Numerous modifications may be made to the invention without departing from its scope as defined in the appended claims.

I claim:

1. A device for playing games comprising:

a field of play formed of squares corresponding to a predetermined crossword puzzle, the field of play including a plurality of playing zones, said zones being defined by a partition member positioned within said field of play;

said partitioned member arranged to partition said field of play into several adjacent zones that can be assigned to different players;

a plurality of interchangeable multi-faced pieces having surfaces with letter indicia adapted to be placed selectively on said field of play to generate field entries for said puzzle with at least one entry made by a player overlapping the playing zone of another player.

2. The device of claim 1, wherein said pieces have a cubic shape.

3. The device of claim 1, wherein said crossword puzzle is defined by entry separated by black boxes and wherein some of said pieces have a black face corresponding to one of said black boxes when said pieces are positioned on said field of play.

4. The device of claim 1, wherein said partition member is adapted to define in said playing field a neutral zone that is not assigned to any player.

5. A device for playing a crossword puzzle based game comprising:

a field of play formed of a plurality of squares arranged in a rectangular array corresponding to a predetermined crossword puzzle, the crossword puzzle including entry boxes and black boxes;

a partitioned member arranged to partition said field of play into several adjacent zones that can be assigned to different players; and a plurality of cubes sized and constructed to fit on said squares and having; faces with indicia selected to allow said cubes to be selectively positioned on said play field on said squares to generate field entries in an arrangement matching said crossword puzzle with at a partition member arranged to partition said field of play into several zones that can be assigned to different players, wherein a game can be played on said field of play by allowing each player to make field entries on said field of play and assigning points for each entry, with entries made by one player in the zone of another player being assigned points differently than entries made by said one player on his own zone.

6. The device of claim 5, wherein said plurality of cubes includes a first set of cubes having faces with alphanumeric elements and a second set of cubes with a face used to indicate a black square.

7. The device of claim 6, wherein said cubes of said first set include five faces with alphanumeric elements and a black face.

8. The device of claim 5, wherein said partition member includes strips for partitioning said playing fields into four equal playing zones.

9. The device of claim 8, wherein said playing zones are arranged in diagonally opposed sets.

10. A method of playing a game based on a predetermined crossword puzzle formed of words, the method comprising the steps of:

providing a field of play corresponding to said puzzle, said field including a plurality of playing zones;

allocating a first playing and a second playing zone to said at least first player and said second player, respectively;

assigning sets of letter indicia to each of a plurality of players; and allowing each said player to make entries by selectively placing said letter indicia on the playing zone with at least one entry overlapping the playing zone of another player to form said words of the puzzle.

11. The method of claim 10, wherein each set is missing some letters of the alphabet.

12. The method of claim 11 wherein said field is divided into a plurality of zones, further comprising assigning at least one zone to each player.

13. The method of claim 12 wherein each zone comprises a plurality of squares, further comprising allowing each player to assign at least one letter selected from his set of letters to each square of his zone.

14. The method of claim 10 further comprising assigning points to each player depending on entries made by said player.

15. A method of playing a game based on a predetermined crossword puzzle formed of words, the method comprising the steps of:

providing a field of play corresponding to said puzzle, said field including a plurality of playing zones;

allocating a first playing and a second playing zone to said at least first player and said second player, respectively;

allowing said at least first player to make a first entry on said first playing zone and a second entry as least partially disposed on said second playing zone; and assigning points for each entry, the points assigned for said first entry being different from points assigned to said second entry.

* * * * *